US006753956B2

(12) United States Patent
Clark et al.

(10) Patent No.: US 6,753,956 B2
(45) Date of Patent: Jun. 22, 2004

(54) AUTOMATED ANALYSIS SYSTEM FOR A DYEBATH

(75) Inventors: James Leonard Clark, Snellville, GA (US); Wayne Coleman Tincher, Doraville, GA (US); Wiley Don Holcombe, Decatur, GA (US); Richard A. Carey, Stone Mountain, GA (US); Elizabeth Wise White, Atlanta, GA (US)

(73) Assignee: Georgia Tech Research Corp., Atlanta, GA (US)

( * ) Notice: Subject to any disclaimer, the term of this patent is extended or adjusted under 35 U.S.C. 154(b) by 428 days.

(21) Appl. No.: 09/847,669

(22) Filed: May 2, 2001

(65) Prior Publication Data

US 2002/0104171 A1 Aug. 8, 2002

(51) Int. Cl.[7] ..... G01J 3/42
(52) U.S. Cl. ..... 356/300; 356/319; 356/326
(58) Field of Search ..... 356/300, 326, 356/328, 409, 410, 411, 433, 434, 435, 436, 440

(56) References Cited

U.S. PATENT DOCUMENTS

| | | | |
|---|---|---|---|
| 3,801,276 | A | 4/1974 | Gray |
| 3,807,872 | A | 4/1974 | Pronier |
| 3,944,383 | A | 3/1976 | Davis |
| 3,966,406 | A | 6/1976 | Namiki et al. |
| 4,104,753 | A | 8/1978 | Schuierer |
| 4,152,113 | A | 5/1979 | Walker et al. |
| 4,165,288 | A | 8/1979 | Teed et al. |
| 4,350,494 | A | 9/1982 | Scheidegger et al. |
| 4,715,863 | A | 12/1987 | Navratil et al. |
| 5,139,533 | A | 8/1992 | Hildebrand |

*Primary Examiner*—F. L. Evans
(74) *Attorney, Agent, or Firm*—Todd Deveau; Thomas, Kayden, Horstemeyer & Risley LLP

(57) ABSTRACT

The present invention is a fully automated modified batch dyeing process that provides a process that reduces water consumption, reduces environmental pollution, and reduces the energy and chemical consumption of the conventional batch dyeing process through efficient reuse of spent dyebath. The invention provides a holding tank which stores the spent dyebath, and an analysis system which allows for the analysis of the dyebath in the holding tank so that the dyebath may be reconstituted and used in the batch dyeing process.

4 Claims, 5 Drawing Sheets

AUTOMATED ANALYSIS SYSTEM FOR A DYEBATH

BACKGROUND OF THE INVENTION

1. Field of the Invention

The present invention relates generally to a textile dyeing method and apparatus. In particular, the invention relates to a modified dyeing method and apparatus comprising an automated analysis system for a dyebath.

2. Description of Prior Art

The textile industry is a major consumer of water. Approximately 160 pounds of water are required to produce one pound of textile product. Most of the 100 billion gallons of water used by the textile industry each year are consumed primarily in the dyeing and finishing processes for the textiles, namely yarn, fabric and carpet. The vast majority of this water is discharged to the sewer. The waste water, or dyebath, includes dissolved and suspended organic and inorganic chemicals, and, thus, the conventional dyeing process places a significant demand on water resources as well as waste treatment facilities, especially in areas such as Dalton, Georgia, where carpet manufacturing plants are highly concentrated.

In a batch dyeing process, one piece (or several pieces) of the textile product is dyed in a vessel containing the dyebath. The bath is agitated or stirred and/or the textile product is tumbled in the bath so that the single dyebath has repeated contact with each portion of the textile product. The vessel may be pressurized, and heat is added to the bath to provide the desired temperature/pressure/time cycle for the dyeing. The piece of textile is then rinsed and removed from the vessel so that another batch may be dyed, and the depleted dyebath is discarded. The textile material is then dried and/or processed further on other production equipment.

In a continuous dyeing process, a piece of textile product is passed lengthwise through one or more pieces of machinery constituting a dye line or dye range. Subsequent pieces of product are sewn together to form a continuous chain of material proceeding through the dye range. The textile material may be exposed to multiple baths (typically of higher concentration than in batch dyebaths), rinses, and drying stages along its path, but it encounters each stage in succession and for a limited time in each.

Typically, continuous dye processes provide economies of scale and are attractive for larger production lot sizes in a particular color, whereas batch dye processes provide manufacturing flexibility and economic benefits in the case of small lot sizes. Certain products are also more amenable to either continuous or batch dyeing processes.

The nature of the batch dyeing process for textiles is especially wasteful. In the conventional batch dyeing processes, the dyebath is used only once per dye cycle, then discharged to the sewer. In addition, the valuable auxiliary chemicals mixed in the dyebath are lost with each discharged batch of water, which themselves place significant loads on the waste treatment system.

Both continuous and batch dyeing processes are common for broadloom carpets. Continuous dyeing offers cost advantages and greater ease in obtaining uniform color over a large production lot size. In contrast, batch dyeing is now used predominately for heavy-weight, high-end carpets which cannot be dyed as well with a continuous processes. Batch processes also offer the advantage of production flexibility due to the small lot size.

The conventional batch dyeing of nylon broadloom carpets is typically performed in an atmospheric vessel, or beck. Water, auxiliary chemicals, dyes and the carpet are loaded in the beck, with the carpet sewn in a loop so that it continuously enters and exits the dyebath, providing agitation and bath-to-carpet contact. The bath is slowly heated and then held at a specified, critical dying temperature for a given amount of time. Both the temperature and hold time are product dependent. As the bath is heated, the dyes penetrate the fiber of the carpet and form chemical bonds. The elevated bath temperature is held for a sufficient period of time to permit the dyes to migrate to a uniform distribution over the carpet, producing a level dyeing. A patch check on the carpet is then performed, and if the carpet is properly shaded, the bath and carpet are then diluted with fresh water to bring the carpet to a temperature acceptable for handling. The carpet is then removed, and the bath including virtually all of the auxiliary chemicals and any residual dyes is drained to the sewer. Several disadvantages of this conventional process are that it consumes excessive water, wastes the stored thermal energy in the dyebath, and releases dyes and auxiliary chemicals to the waste stream.

The dye used in the batch dyeing process is typically a mixture of three components—yellow, red and blue—with a ratio and total quantity selected to give the designed color for the textile product. The auxiliary chemicals used in the batch dyeing process typically include wetting agents, pH control agents, leveling agents, chelating agents, and others which aid the dyeing process, but are not consumed during the dyeing process like the dyes are consumed.

Generally, by the time the finished color of the carpet is achieved in the conventional batch dyeing process, the dyebath has undergone several changes. The dyebath temperature is about 200° F., in contrast to the initial starting, ambient temperature of about 60° F. There has been a small amount of dilution to the dyebath due to condensate of the injected steam, the preferred mode of heating. Most but not all of the dye has been transferred from the bath to the carpet fiber, but the auxiliary chemicals are essentially unchanged, and remain in the bath.

This spent dyebath, destined for the sewer in the conventional process, represents a significant investment of energy and chemicals which are available for reuse. Dyebath reuse offers the opportunity to reduce the consumption of water resources, to reduce energy consumption in the dyehouse, to conserve/reuse expensive auxiliary chemicals, and to reduce environmental pollution. There is also the potential for production rate increases due to reduced heatup times required by the present invention.

Presently, only for certain combinations of dyes and fibers, there is the possibility to reuse spent dyebaths in subsequent dyeings. However, for these combinations the amount of residual dye left in the baths is generally sufficient to result in off-shade dyeings of subsequent batches. Therefore, for these combinations, the concentration of residual dye for each of the component dyes must be accurately determined, and the recipe for the next dyeing be adjusted accordingly.

Dyebath reuse with manual intervention has been demonstrated on a limited scale for a wide variety of textile products. Yet the barrier to industry-wide implementation is the human involvement required to implement dyebath reuse. A trained chemist is necessary to collect test samples at the end of every dye cycle. The samples must then be transported to an equipped laboratory and analyzed for dye concentrations, and the corrected recipe calculated. It simply is not practical to have personnel on hand round-the-clock to perform these analyses since it can be difficult to find trained chemists willing to work on all shifts, and the employment costs are prohibitive. Further, the human involvement may also lead to analysis and/or calculation errors. Therefore, a solution to this problem is to automate the dyebath analysis process, which the present invention provides.

Various methods and apparatus are known in the textile industry that attempt to relieve some of the disadvantages of the conventional batch dyeing process. For example, U.S. Pat. No. 3,807,872 to Pronier, entitled "Process For Regulating The Concentration Of A Bath Of Dye Or Coloring And Equipment For Implementing This Process" discloses a method and apparatus to control concentration of a dye in a dyebath linearly over time. As disclosed, the first step is the preparation of the dyebath using all the additives except the dye substances. Then a certain volume of the dyebath is taken to act as a pure reference sample. Selected coloring agents are then added to the dyebath and in this way an initial real bath is obtained for dyeing the article. From this real bath, a certain volume is drawn off to form an initial mixed sample. A theoretical consumption curve is simulated by adding steadily and continuously to the initial mixed sample a certain amount of the pure sample. A continuous and steady flow is extracted from the mixed sample and directed to an analysis vessel. Simultaneously, a steady and continuous flow of liquid from the real bath, to which the article to be dyed is added, is directed to a second analysis vessel. Then through analysis, for example, by colorimetry, the liquids passing through the vessels are analyzed. When a difference is detected between the analysis signal corresponding to the mixed sample and real sample, the equilibrium parameters of the real bath are modified in order to cancel out the difference between the two signals.

Specifically, Pronier describes the desire to regulate the rate of change of dye concentration in a bath while the dyeing progresses. It suggests that the rate be regulated by temperature control with regulation efforts which compare the changing color of the dyebath to the changing color of a reference solution. Pronier changes the color of the reference at a linear rate by dilution.

While Pronier describes a desire to make optical measurements on a continuous sampling basis, it describes reasons that this cannot suitably be achieved. Further, the disclosure of Pronier makes clear that the technique does not involve the absolute measurement of the color of the bath. The present invention's automated analysis system has the capabilities to make the measurements which Pronier suggests can not be done; it can accurately measure the color spectrum of the bath and, therefore, can compute the concentration of each of the individual component dyes. Further, the present invention measures spent dyebaths for reuse in a completely different application of dyebath analysis than Pronier provides, and one for which Pronier is not suitable.

U.S. Pat. No. 4,152,113 to Walker et al., entitled "System For Dyeing Hosiery Goods" discloses a system for batch dyeing hosiery goods where the dyebath is recycled and reused in successive dyeing cycles. The dyebath unabsorbed by the hosiery goods is removed from the dye vat or container and directed to a waste water holding tank. Subsequently, spent rinse and finish waters are transferred from the vat to a waste water holding tank after the various rinse and finish operations. Periodically, the waste fluids are directed to a treatment zone where they are clarified sufficiently for utilization in the bath, rinse and finish operations in subsequent dyeing cycles. A small amount of the dyebath directed from a dye waste tank back to a machine via line for a subsequent dyeing cycle is diverted through a line and analyzed by instrumentation to determine the quantities and colors of the various dyes that must be added to result in a desired dye shade of the hosiery goods.

Walker et al. describes a process to clean up dyeing waste water so that it can later be reused. The Walker et al. process specifically attempts to remove the residual dye from the spent bath during the treatment process. The present invention does not rely on a waste treatment system. Instead, it reuses as much of the water, residual dye, auxiliary chemicals, and energy as possible by adding the necessary makeup chemical and dye quantities to make the bath suitable for the next batch. This approach requires the use of an analysis system to reveal the makeup quantity of dye required, but offers greater reuse benefits and avoids the treatment system capital and operating costs.

U.S. Pat. No. 4,350,494 to Scheidegger et al., entitled "Process For The Dyeing Of Textile Material And Apparatus For Carrying Out The Process" discloses batch dyeing of carpet materials, as well as reconditioning and reuse of the exhausted dyebath. The process is characterized in that during dyeing the pH value is lowered, by the addition of an inorganic acid, by at least one unit of pH value. A liquid circulating system is provided including pH monitoring means and dosing means for automatically adding the necessary make-up chemical agents.

Scheidegger et al. describes a process in which pH adjustments are used in an attempt to get all of the dye to be taken up by the product so that there is no residual dye in the spent bath. In the commercial batch processes for nylon carpet of the present invention, there is a small but significant quantity of residual dye in the spent baths. This amount cannot be ignored in a dyebath reuse process without off-shade dyeing in subsequent batches. The present invention operates successfully even if all of the dye happens to be taken up by the product, but also offers the flexibility of being able to deal with the residual dyes that are more typically encountered.

In view of the prior art it can be seen that there is a need for a modified dyeing process incorporating an automated dyebath analysis system that reuses the conventionally wasted dyebaths. It is to the provision of such a method and apparatus that the present invention is primarily directed.

BRIEF SUMMARY OF THE INVENTION

Briefly described, in an exemplary form, the present invention overcomes the above-mentioned disadvantages by providing a modified batch dyeing method and apparatus having an automated dyebath analysis process. The present invention, which applies hot-start and hot-termination to the conventional dyeing process which uses cool-start and cool-termination, modifies the conventional dyeing process to specifically incorporate reuse of the dyebath.

The present invention modifies the conventional batch dyeing process by, in an exemplary embodiment, providing a holding tank separate from the conventional beck, and connected to the beck by appropriate plumbing, which can be added to the conventional batch dyeing apparatus. Further, the present invention has an automated analysis system to analyze the dyebath in the holding tank to accurately determine concentration levels of dyes in the dyebath.

At the same time that the present modified dyeing process prerinses a first carpet of several carpets to be dyed in the beck, the holding tank is filled with water, and auxiliary chemicals are added to the water in the holding tank. Then the proper concentration of dyes are mixed in the dyebath in the holding tank. When the prerinse bath of the present process is dumped to the drain, the present invention transfers the dyebath from the holding tank to the beck via plumbing lines. Upon transferring the dyebath to the beck, the holding tank is rinsed, and the rinse is flushed to the beck.

At this time the beck is fall of dyebath which includes the proper concentration of dyes and auxiliary chemicals, and the holding tank is empty. The temperature of the first bath is slowly heated while the carpet tumbles in the bath. When the temperature of the dyebath reaches the critical dying hold temperature for the type of carpet, the hold temperature of the dyebath is held for a period longer than the conventional process hold time.

Upon a successful patch check of the carpet, a portion of the dyebath is transferred to the holding tank. At this point, the beck is not empty of bath so as to keep the carpet somewhat buoyant, and the holding tank is only partially full. The beck and carpet is then bathed in a cool rinse of water and the carpet brought to a temperature lower than the critical temperature. A portion of the bath in the beck (including the rinse water) is then transferred to the holding tank. At this point, the holding tank is filled with the proper amount of dyebath to be used in the next cycle, and the remaining bath in the beck is drained to the sewer.

Then a cool water rinse is applied to the carpet in the beck to bring the temperature of the carpet to a safe handling temperature and the rinse water left in the beck. While the first carpet is pulled from the beck, a sample of the dyebath in the holding tank is analyzed, and any required auxiliary chemicals and dyes are added to the dyebath.

A second carpet is then installed in the beck, and prerinsed with the rinse water left in the beck from the first carpet dyeing process. This water is then drained from the beck. Then the heated dyebath in the holding tank, which is at an elevated temperature and composed of the proper concentrations of chemicals and dye, is transferred to the beck and the process is repeated.

Several challenges were overcome in order to make dyebath reuse possible and attractive to the textile industry. Generally, the waste produced by conventional dyeing process challenged the inventors to create a more efficient dyeing process. Reuse of the dyebath was an opportunity to significantly curtail the waste of dyes, auxiliary chemicals, thermal energy, water, and effluent of the conventional batch dyeing process. Yet the process of dyebath reuse presented its own challenges, challenges which are overcome by the present invention.

The first challenge was in the necessary changes to the conventional dyeing process. Conventional dyeing starts cold with gradual heating, and at the end of the cycle, the bath and carpet are cooled by dilution. Yet, for effective capture and reuse of the energy and chemicals, the bath must be recovered hot, without significant dilution, and the subsequent batch must be started hot. Yet if the conventional process were to use hot-start and hot-termination of the dyeing process, it would result in product quality defects, and suitable adjustments would have to be developed and implemented. Therefore, the industry did not attempt this approach.

The second challenge was represented by the small and variable quantity of residual dyes in the spent bath. If these were neglected when a dyebath was reused, subsequent dyeings would be off-shade. It was necessary for the spent bath to be captured, analyzed for the residual quantity of each dye component, and reconstituted to the proper concentration of each dye component as called for in the recipe for the subsequent batch.

In order to be eligible for dyebath reuse, the subsequent batch must use the same auxiliary chemical recipe and the same component dyes as the previous batch, although it may specify a different shade. In most dyehouses, the majority of the products can be dyed with a combination of just three dyes, typically a yellow, a red, and a blue. Some colors may require a different combination, such as a different yellow dye, or an orange dye instead of yellow. Carpets which use different component dyes in their recipes cannot be dyed in the same reuse sequence because of the dye contamination which would result.

The third challenge was the automation of the present invention. Several industrial scale demonstrations of dyebath reuse were conducted in the 1970's and 1980's, demonstrating the technical feasibility and economic advantages. The process did not achieve commercial acceptance because of the required human involvement. Even though the savings could justify the added labor, plants were not prepared to accept the additional tasks, the additional technical expertise required, nor the risk that human delays or errors in chemical analyses and calculations could adversely impact the production schedule. Thus, commercial acceptance of dyebath reuse required that the process be automated and not impose significant burdens on the production system.

Thus, the present invention comprises a modified batch dyeing method and apparatus that removes the quality defects associated with conventional attempts at a hot-start, hot-termination dyeing process, an analysis process and apparatus to analyze the spent dyebath that will be reused, and provides the necessary automation of the entire process to make the present invention economically attractive to the textile industry.

Three steps are introduced to the conventional batch dyeing process by the present invention to overcome the various problems associated with the hot-start of the batch dyeing process:

1. The carpet is pre-rinsed in a bath containing a leveling agent so that the entire carpet is "treated" with the leveling agent before it comes in contact with the dye. This additional pre-rinse step is introduced before the dyeing process begins to remove finishes and tints which are added to the fibers during the carpet's initial processing.
2. The dyebath is prepared in a separate vessel from where the dyeing is performed so that the dyes can be fully diluted in the bath prior to contact with the carpet. The conventional process adds the dyes directly to the bath in the process vessel which may lead to the problem of spot dyeing.
3. The hold time at the maximum normal process dying temperature (critical dying temperature) is extended to permit migration of the dye from point to point on the carpet to achieve levelness of dyeing. The additional process time added is balanced by the reduction in the time needed to heat the bath since the bath is hot at the beginning of each reuse batch.

Process quality defects associated with the hot-termination of dyeing are also avoided in the present invention. Upon the expiration of the conventional process hold time, and before the final cool rinse of the carpet, the present invention slightly cools the bath below a certain, critical cooling temperature that is only a few degrees below the normal process dying temperature. When the bath temperature is lower than the critical cooling temperature, it is transferred to the holding tank for reuse, and a further cool rinse bath may be introduced into the beck to cool the carpet for safe handling. It has been found that when the bath and carpet are slowly cooled below the critical temperature before transferring the bath to the holding tank, the quality defects of the conventional process do not occur when coupled with hot-termination.

The present invention incorporates an automated system to continuously analyze the spent dyebath to determine the concentration of each component of the residual dyes. The automated analysis system provides the analysis so the bath may be reconstituted to the proper dye concentrations for the next dyeing batch. By automating the analysis process, the adverse human factors previously addressed are eliminated. The automated analysis system is can be interfaced with the plant's existing process control system and incorporates all of the required chemistry expertise in the analysis system's hardware and software.

The analysis technique for the automated analysis of the spent dyebath is preferably absorbance spectrophotometry. In one embodiment, a dual flow cell permits a single light source to illuminate both a sample of the dyebath and a sample of a reference solution consisting of water and all of the auxiliary chemicals in the same concentration as in the dyebath (i.e., everything except the dyes). The light passing through the two samples is captured by optical fibers and carried to a dual-beam spectrophotometer which measures the light absorbance for the wavelengths covering the visible spectrum. The absorbance spectrum for the reference sample is subtracted from the spectrum for the dyebath sample, providing the absorbance spectrum of just the residual dyes.

Another embodiment of the analysis system involves a single-beam configuration. This involves measuring both the reference solution and the dyebath sample in the same flow cell at different times. This embodiment involves only one single flow cell, one light source with no beam splitter, and a single beam spectrometer. The measurement of the reference solution may be performed either just prior to, or well in advance of the dyebath sample and stored in an electronic file.

Objectives of the present invention include reduced water consumption, reduced environmental pollution, and energy and chemical conservation through efficient reuse of the dyebaths. The present invention incorporates these objectives which leads to an economically-attractive modified batch dyeing process.

Thus it can be seen that there is a need for a modified batch dyeing process comprising an automated dyebath analysis system that reuses the conventionally wasted dyebaths, and that is capable of a hot-start and hot-termination. It is to the provision of such a method and apparatus that the present invention is primarily directed.

DETAILED DESCRIPTION OF A PREFERRED EMBODIMENT

Figure 1:
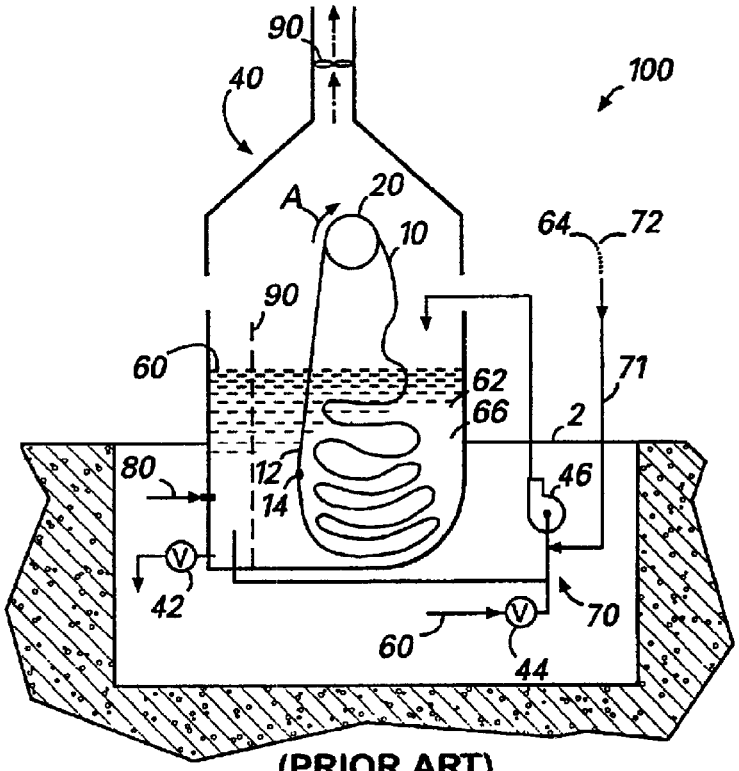
(PRIOR ART) FIG.1
FIG. 1 is a diagram of the conventional batch dyeing process. (Prior art).

Referring now in detail to the drawing figures, wherein like reference numerals represent like parts throughout the several views, the standard production method and apparatus 100 of the batch dyeing of nylon carpet is shown in FIG. 1. Generally, the conventional batch dyeing apparatus 100 comprises a beck 40 which is the vessel in which the batch dyeing occurs. Typically, the beck 40 is sunk below the floor 2 of a manufacturing plant. At the start of the conventional batch dyeing process, the beck 40 is partially filled with water 60 and the carpet 10 arranged in such a way in the beck 40 so that the carpet 10 is continuously run in and out of the water 60.

It will be understood by those skilled in the art that references to carpet 10 are merely illustrative of many products that may subjected to the batch dyeing process.

Auxiliary chemicals 72 and dyes 64 are added to the water 60 via tubing 71, which when mixed together, produce dyebath 66. Tubing 71 is generally an extension and component of the circulation loop 70 wherein a pump 46 provides the mixing to the dyebath 66 in the beck 40 to maintain uniformity of temperature and dye 64 distribution in the bath 66. The bath 66 is then slowly heated to a critical dying hold temperature (dependent on the type of carpet 10), and held at the critical dying hold temperature for a specified period of time (also dependent on the type of carpet 10). During the entire heating and holding process, the carpet 10 is tumbled in the bath 66 providing agitation, and the bath 66 recirculated. Also during the entire process, an exhaust means exhausts the interior gases of the beck 40 to the atmosphere. The exhaust means may comprise exhaust fan 90 located at the top of the beck 40. Once the carpet 10 is at the proper shade, the carpet 10 and dyebath 66 are cooled by a rinse, and the carpet 10 removed from the beck 40. The dyebath 66 is then drained from the beck 40.

In a more detailed description of the conventional batch dyeing process, carpet 10 is generally rolled onto a reel 20 in a conventional beck 40, and the ends 12, 14 of the carpet 10 are sewn together around the reel 20. In this configuration, the carpet 10 is a continuous loop of carpet. Then the beck 40 is filled with water 60. Alternatively, water 60 may be added to beck 40 simultaneously with the sewing. The carpet 10 is moved in and out of the bath 60 by rotating the reel 20, as shown by Arrow A, which saturates continuous portions of the carpet 10 with water 60. The auxiliary chemicals 72 (wetting agents, pH control agents, leveling agents, chelating agents, etc.) are added to the water 60 via the recirculation loop 70 having a recirculating pump 46. Then dyes 64 are introduced into bath 62 (bath 62 is the combination of water 60 and chemicals 72) which then produces bath 66. It should be noted that generally the dyebath proceeds through three distinct phases. In the first phase, the dyebath 60 comprises only water 60. In the second phase, dyebath 62 comprises water 60 and auxiliary chemicals 72. In the third phase, dyebath 66 comprises dyebath 62 with the addition of dyes 64.

The bath 66 is then heated by the direct injection of steam 80 at generally a rate of approximately 2–3° F. per minute. A perforated baffle 90 protects the loop of carpet 10 from the recirculation loop 70 and from coming in direct contact with the injected steam 80. The bath 66 is heated from the ambient temperature (year-round average of ~60° F.) to a temperature of approximately 200° to 208° F., depending on the product. As the temperature of the bath 66 is increased, the dyes 64 begin to absorb onto the surface of the carpet 10 and diffuse into the amorphous regions of the fibers of carpet 10. The bath 66 is then held at a holding temperature for the carpet for approximately thirty to sixty minutes while the carpet 10 is continuously circulated through the bath 66. This agitation provides sufficient time for dye 64 migration in order to ensure a level dyeing. After the hold time has elapsed, the heating stops, and a small patch of the carpet 10 is tested to see if the carpet 10 is the proper desired shade.

Figure 2A:
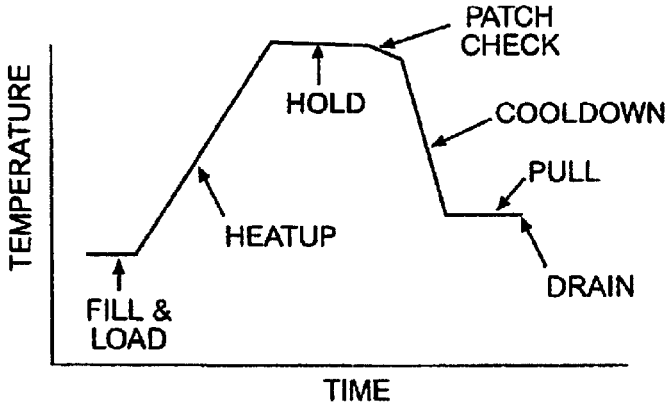
FIG. 2*a* is a temperature vs. time profile for the conventional dyeing process.
Figure 2B:
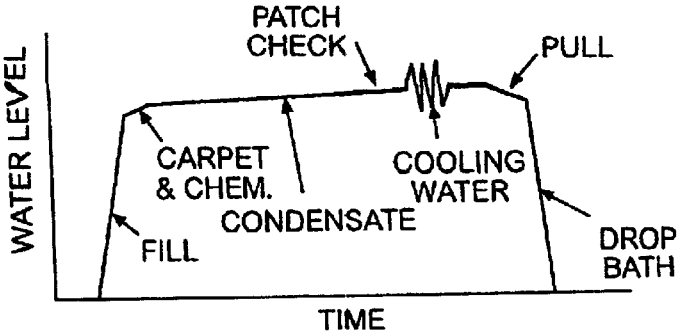
FIG. 2*b* is a water level vs. time profile for the conventional dyeing process.

If the carpet 10 is on shade, the carpet 10 is then cooled by dilution with cold water 60, thus raising the residual bath's 66 level in the beck 40. A drain 42, located at the bottom of the beck 40 is then opened and the bath 66 level is dropped. The drain valve 42 is then closed and a water fill valve 44 in loop 70 is opened until water 60 raises the level of the dyebath 66 in the beck 40. This cycle is repeated until the temperature of the bath 66 has reached approximately 105° F., then the carpet 10 is removed. The entire bath 66 (assuming some trace of dyes 64 and residual chemicals 72 remain in the cold rinse water 60) is then discharged to the drain 42. A typical water level vs. time and temperature vs. time profile for this process is shown in FIGS. 2*a* and 2*b*. Depending on the product to be dyed in the next load, the beck 40 may or may not be cleaned at this time.

Alternatively, if the patch check shows that the carpet 10 is not on shade, the proper adjustments to the bath 66 are estimated, and then make-up dyes 64 are prepared and added to the bath 66. The make-up dyes 64 may also be referred to as adds 64. The bath 66 is then reheated to the hold temperature and held again at the hold temperature but for approximately half as long as before, after which another patch check is conducted. This cycle is repeated until a suitable dyeing is achieved. Then the bath 66 is cooled and the carpet 10 removed in the same manner.

This conventional procedure is simply not compatible with effective collection of the dyebath 66, since not only the energy in stored heat is lost, but most of the valuable chemicals 72 will have been diluted and lost with the overflow. Further, the dilution cooling step of the process involves a significant quantity of overflow to the sewer. In order to save the thermal energy, residual chemicals 72 and dyes 64, water 60, and the spent dyebath 66, a portion of the bath 66 must be collected while it is undiluted and still hot, and the next dyeing started at an elevated temperature. Yet this procedure leads to several problems.

If dyebath 66 reuse were implemented with the sole objective to maximize recovery of energy and chemicals 72, then the dyebath 66 would be captured for reuse immediately after the patch check of the carpet 10 is completed. Since the carpet 10 cannot be pulled from the beck 40 while it is hot, it would be necessary to transfer the entire bath 66 to a holding tank and cool the carpet 10 in the beck 40 with a rinse bath 60. This is called a "hotdrop" or "hot-termination" process. Unfortunately, it can lead to defective carpets.

If the 200° F. dyebath 66 were transferred to a holding tank, the hot carpet 10 would be left folded in the bottom of the beck 40, with a small fraction of the carpet 10 still looped over the reel 20. Without the buoyancy provided by the bath 66, the carpet 10 could not tumble by rotating the reel 20. As the cold rinse water 60 is added to the beck 40, the carpet 10 would experience rapid cooling, which itself specifically leads to two kinds of quality problems. One is a localized problem, where cold water 60 gives a thermal shock to a fiber tuft, sometimes giving a defect known as "blooming." More notably, as the folded carpet 10 is cooled by the rinsing water 60, the yarn passes through a transition temperature, and the fibers are set in their position. This results in permanent creases in the surface fiber, a condition known as a "pile deformation" problem.

Neither blooming nor pile deformation problems can be corrected after they occur, so the carpet 10 cannot be sold as a first-quality product. In the conventional dyeing process, these quality problems are avoided by gradually cooling the carpet 10 while keeping it floating in the bath 66 and tumbling over the reel 20.

Recovering the dyebath 60 hot would mean that the subsequent cycle would start at an elevated temperature. While this is desirable from an energy conservation standpoint and even offers a possible production rate improvement, it can lead to additional quality problems. At elevated temperatures, the dyes 64 penetrate the fiber and form their chemical bonds much more readily. As a result, dyes 64 tends to bond to the first portion of the carpet 10 they touch, creating non-uniform coloring or unlevel dyeing. In conventional dyeing, the process starts cold, and the continued agitation of the carpet 10 and circulation of the bath 66 contribute to a level dyeing as the temperature increases.

Because of these product quality problems associated with the constraints imposed by dyebath 66 reuse, the conventional dyeing process is modified by the present invention which is compatible with reuse of the baths 66.

The present invention modifies the apparatus of the conventional batch dyeing process by providing a holding means 110 to hold the hot, spent dyebath 66 once in beck 40, and a transfer means 120 to transfer the spent dyebath 66 from the beck 40 to the holding means 110, and transfer means 122 to transfer reconstituted dyebath 130 from the holding means 110 to the beck 40. Further, the present invention preferably comprises an analysis system 200 which analyzes bath 130 so that bath 130 may be reconstituted with dyes 64 and auxiliary chemicals 72 while the bath 130 remains in the holding means 110.

It will be understood by those in the art that the holding means 110 may comprise any suitable vessel or the like that can store heated dyebaths 66. Further, the transfer means 120 and 122 may comprise any suitable plumbing and pumping network which can transfer portions of the dyebath 66, dyebath 130 and water 60 to and from the beck 40 and the holding means 110.

Figure 3:
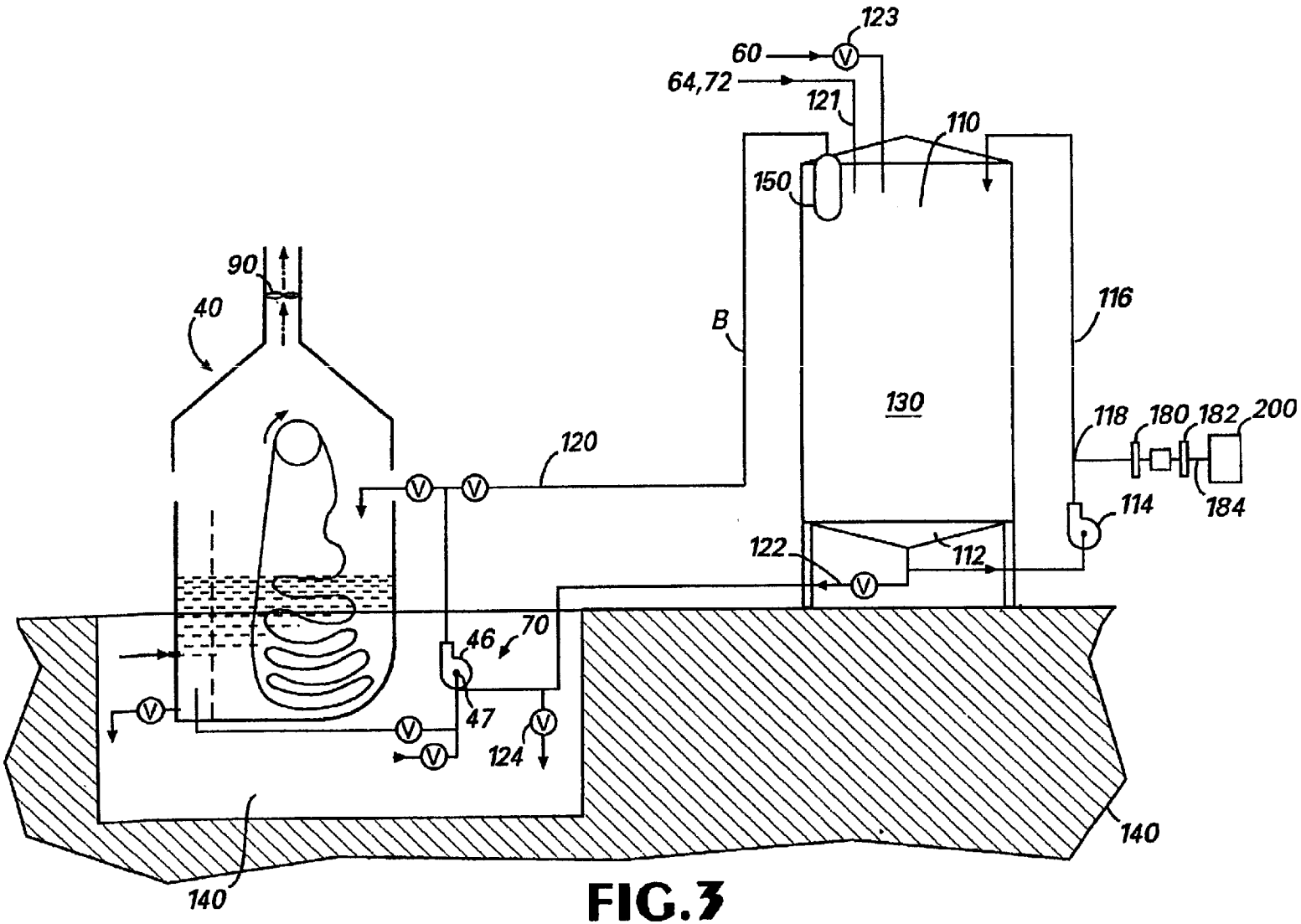
FIG. 3 is a schematic of one embodiment of the present invention used in conjunction with the prior art batch dyeing process.

In order to capture the maximum amount of chemicals 72 and energy from the spent dyebath 66, a significant portion of the bath 66 must be recovered before the dilution cooling occurs. The present invention transfers the bath 66 out from the beck 40 and preferably to a holding tank 110 as shown in FIG. 3. Dyebath in the holding tank 110 is referred to as dyebath 130. To avoid the present quality defects associated with hot-termination, after cooling water 60 is added to the beck 40 to reduce the temperature of the carpet 10 and remaining bath 66 below the critical temperature that is only a few degrees below the normal process temperature, a portion of the dyebath 66 is transferred to the holding tank 110 to provide an adequate quantity for the subsequent batch.

In one embodiment of the present invention, the holding tank 110 is a cylindrical tank 12 feet tall and 8.5 feet in diameter, and has a shallow conical bottom 112. Tubing 120 is added to the conventional beck 40 plumbing 70 so that a typical 800 gpm circulating pump 46 on the beck 40 can also be used to transfer the bath 66 to the holding tank 110 along a path indicated by Arrow B. The holding tank 110 is also equipped with a 100 gpm recirculating pump 114 which serves several purposes. A pump discharge line 116 provides for a convenient point 118 to pull off samples of spent dyebath 130 to be sent to the analysis system 200 for testing. After any makeup auxiliary chemicals 72 and dyes 64 are added to the holding tank 110, the recirculating pump 114 also provides mixing of the bath 130 in the holding tank 110. It should be noted that reference to the following specific components are for illustration only, and refer to a retrofit embodiment of a dyeing process provided the inventors at a manufacturing plant.

Figure 4A:
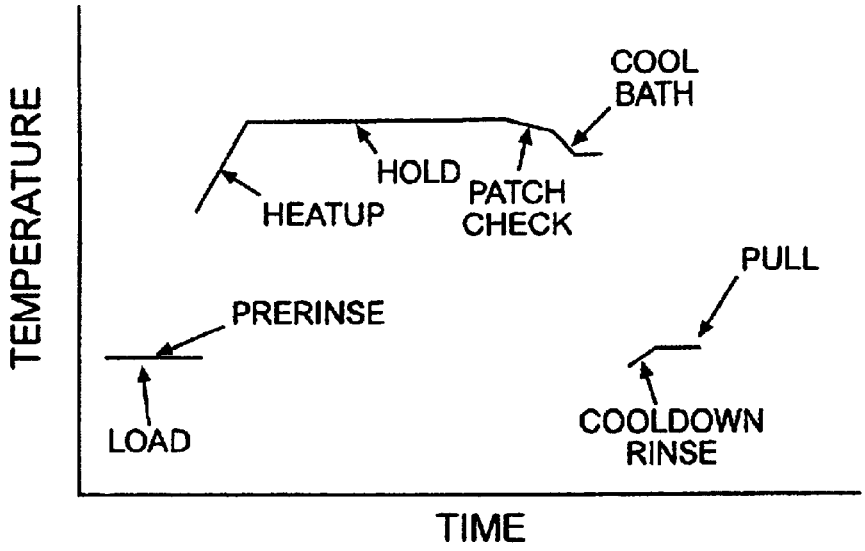
FIG. 4*a* is a temperature vs. time profile for a modified dyeing process, according to a preferred embodiment of the present invention.
Figure 4B:
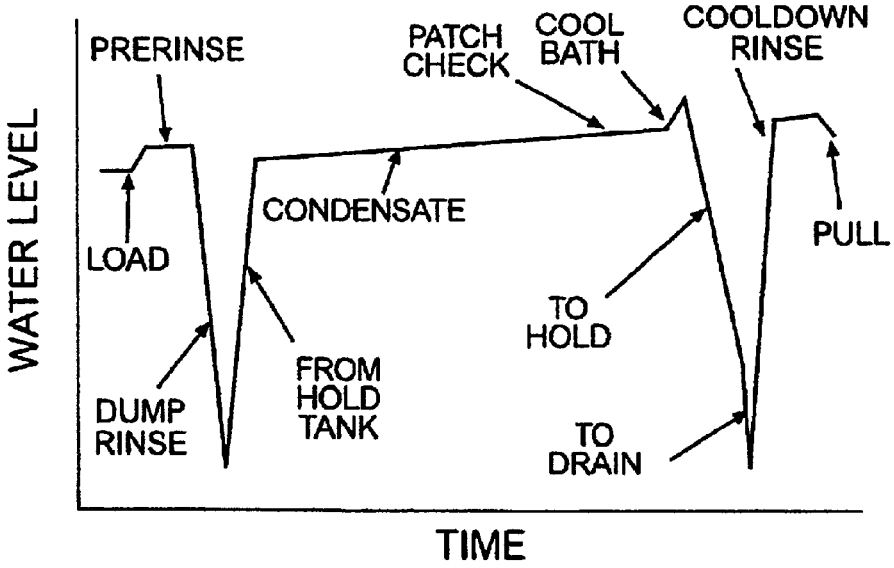
FIG. 4*b* is a water level vs. time profile for a modified dyeing process, according to a preferred embodiment of the present invention

During the modified process of the present invention, chemicals 72 and dyes 64 are added to the bath 130 in the holding tank 110 via tubing 121, and not the beck 40, so that the bath 130 will be fully mixed before it comes in contact with the carpet 10 in beck 40. This modification helps prevent the levelness problems. A drain line 122 of the holding tank 110 is connected to the suction side 47 of the recirculating pump 46 on the beck 40. The drain line 122 comprises a valve 124 which permits the holding tank 110 to be drained to a trench 140 when necessary. A water level vs. time and temperature vs. time profile for a preferred embodiment of the present invention is shown in FIGS. 4(*a*), 4(*b*).

Preferably, a vortex breaker (not shown) is located in the bottom 112 of the holding tank 110. The holding tank 110 was originally designed as simply a storage tank, and was not intended for the high discharge rates required for the modified process. When it was used with a high transfer rate, a vortex formed inside the tank 110 and air was sucked into the discharge line 122. This inhibited the full transfer of the bath 130 from the holding tank 110 to the beck 40. This problem was resolved by installing a vortex breaker in the bottom 112 of the holding tank 110.

During early trials of the present invention, it was also found that lint accumulated in the holding tank 110. This would lead to analysis errors because significant amounts of dye 64 remained in the lint. Further, the lint could clog the drain line 122. In order to prevent lint from accumulating in the holding tank 110, a lint filter 150 was added where the tubing 120 enters at the top of the holding tank 110. The filter 150 preferably comprises a metal strainer with a replaceable fiber bag made of carpet backing.

A water line 123 may also connect to the top of the holding tank 110. After the bath 130 is transferred back to the beck 40, a small amount of fresh water 60 is added to the holding tank 110 to flush out the remaining dyebath 130 left in the bottom of the tank 110 into the beck 40.

The holding tank 110 may have a sight glass (not shown) so that the level of the bath 130 can easily be seen. Further, an adjustable probe (not shown) may be added in the holding tank 110 so that the amount of dyebath 130 in the tank 110 is known.

The analysis system 200 of the present system uses absorbance spectrophotometry to determine the concentration of each of the dyes in the dyebath. In one embodiment, the concentration of three component dyes 64 (yellow, red, and blue) in the spent dyebath 130 is analyzed. In another embodiment, the entire visible spectrum of data is analyzed.

Figure 5:
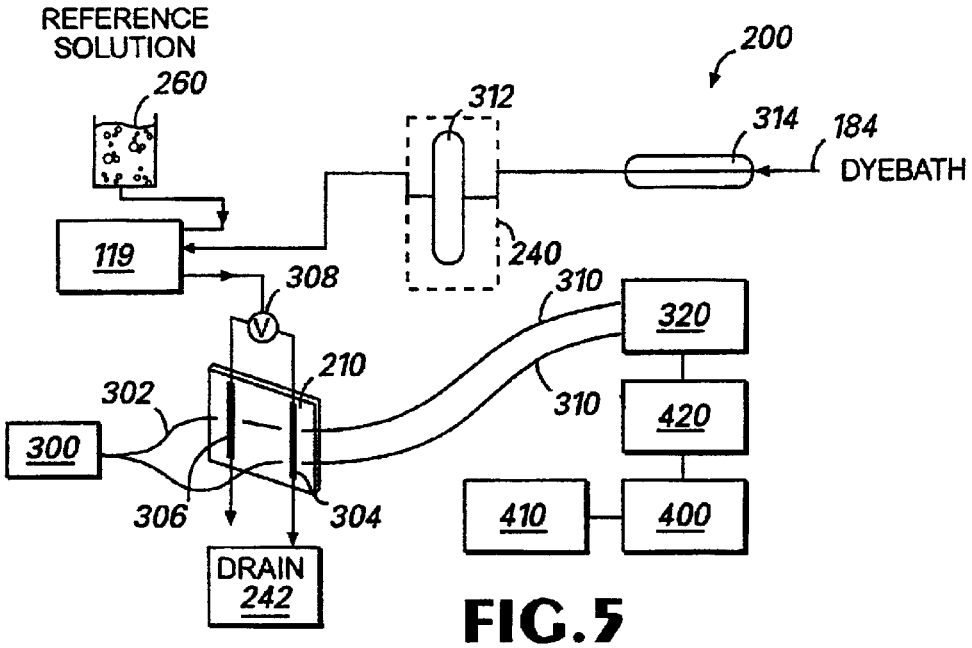
FIG. 5 is a schematic view of the components of an analysis system of the present invention according to one embodiment involving a dual beam configuration.

As shown in FIG. 5, one form of the analysis system 200, namely a dual-beam configuration, includes a light source 300, a metering pump 119, a dual flow cell 210, fiber optic cables 310 and a dual beam spectrophotometer 320 that sends data to a personal computer 420 for analysis. The makeup quantity of the auxiliary chemicals 72 is calculated based on dilution and losses of bath volumes.

In trials of the analysis system 200 of FIG. 5, the pump 119 was a Constametric 4100 manufactured by Thermo Separation Products. The Constametric has four inlet ports that are capable of pumping precise ratios of up to four solutions at a time, at flow rates of up to 10 ml/min. This allows a reference solution to be simultaneously drawn from a reservoir 260 through one inlet port, while the spent dyebath 130 from the holding tank 110 is drawn from a sample reservoir 240 through another port. The pump 119 also allows the option of diluting samples with reference solution if the concentrations are too high to be accurately measured using Beer's Law. Alternatively, the reference solution can be measured in advance of measurement of the dyebath sample with the reference solution data stored in an electronic file.

Theoretically, absorbance is a linear and additive function of concentration of the component dyes (Beer's law). For simplicity, such linearity can be used for calibration, although absorbance can be non-linear. Therefore, the concentration of each of the dyes in the bath may be determined using calibration curves developed for the specific set of dyes. Causes of non-linearity and methods for responding to it in the analysis have been addressed by White et al. (1996).

One form of light source 300 that can be used is a 3,100 K LS-1 tungsten halogen lamp manufactured by Ocean Optics, Inc. The light coming from the light source 300 is split into two beams with a 200-micron Y-cable 302. Each side of the Y-cable illuminates one side of the flow cell 210.

One example of a suitable dual flow cell 210 is manufactured by Thermo Separation Products. The cell 210 has two identical quartz cells 304, 306 with a path length of 1.0 cm. One side is used for the reference solution samples, and the other side is used for the dyebath samples. A three-way valve 308 controlling the output of the metering pump 119 is turned on so that the reference side of the cell 210 can be filled with the reference solution. This solution remains in the reference side of the flow cell 210 for the entire reuse sequence. At the beginning of each dyebath reuse sequence, a new reference sample is obtained. The three-way valve 308 is switched so that the sample of spent dyebath 130 is pumped through the sample side of the flow cell 210. A flow rate of 10 ml/min can be pumped for three minutes to flush the cell 210 out, then at 2.5 ml/min while the measurements are taken. Light transmitted through the cells 304, 306 is sent through a set of 62.5 micron cables 310 approximately 400 feet long to the control room and the spectrophotometer 320. Of course, the reference side of the cell is not needed if the reference solution is measured in advance and stored electronically.

A flow cell holder (not shown) can be used to connect the fiber optic cables 310 to the cell 210. Since the flow cells 304, 306 were spaced only ¼-inch apart, conventional connectors on the ends of the cables 310 are too wide to be placed side by side in order to illuminate each side of the flow cell 210. The connectors were removed from the cable 310 ends, and an adapter added to hold the cables 310 firmly in position.

A suitable detector that can be used is a dual beam SD 1000 spectrophotometer 320 manufactured by Ocean Optics, Inc. The recent development of detectors that can measure absorbencies at multiple wavelengths simultaneously has revolutionized the design of spectrophotometers. It is now possible to analyze for multiple components in a dyebath quickly and precisely. These new detectors have made possible the development of on-line dyebath analysis systems which can measure concentrations in real time. Previously, samples had to be measured manually at each wavelength. Also, new low-cost, dual beam spectrophotometers have been developed which can measure absorbance of both the background solution and the dyebath simultaneously. The previous dyebath reuse process required that the dyes be separated from the background using solvent extraction, which is a very time-intensive process. These spectrometers can be directly connected to and controlled by desktop computers, permitting convenient data analysis and interface to the production systems. These advances in technology now allow the dyebath analysis process to be automated and implemented on a commercial scale.

In the operation of this embodiment of the analysis system 200 of FIG. 5, samples of the spent dyebath 130 in the holding tank 110 are drawn from the circulation line 116 on the tank 110 by a ½ gpm transfer pump 180 and delivered through a Y-strainer and a backflushable filter 182, as shown in FIG. 3. A flow rate in this range is desired in order to purge the transfer line 184 quickly and expedite the analysis procedure. Only a few milliliters of the bath 130 are required for the actual analysis. The bulk of the flow is sent to a drain 242 for the few minutes the pump 119 is running in this sample-and-analyze step, since the plumbing needed to return the flow to the tank 110 is not justified by the few gallons which are lost. A small portion of this flow is diverted for preparation and analysis.

In order for the samples of the spent dyebath 130 to be analyzed properly in this embodiment, the samples should be cooled to ambient temperature and filtered, and flow should be maintained without allowing air bubbles to enter the flow cell 210. The flow first passes through a heat exchanger 314 that, in one embodiment, comprises concentric tubes 230 (⅛" stainless steel inside ¼" copper) coiled in a helix. The dyebath 130 flows in the inner tube and is surrounded by counterflowing water 60 in the outer tube of the coil. Heat exchanger 314 cools the flow from generally 190° F. to ambient because in this embodiment, calibration of system 200 was at ambient.

Figure 6:
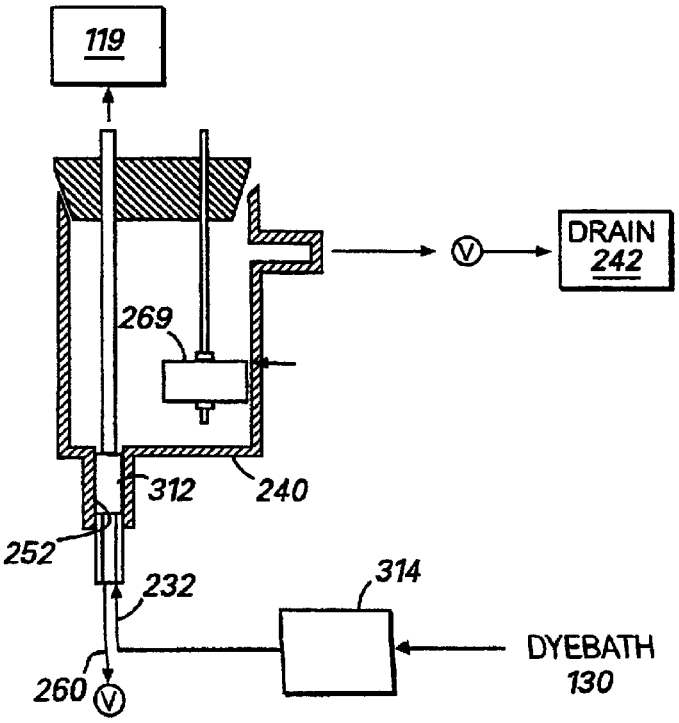
FIG. 6 is a schematic view of a reservoir involving an analysis system of the present invention.

The cooled dyebath sample then enters the bottom of the glass reservoir 240, shown in FIGS. 5 and 6, with a significant portion overflowing the reservoir 240 and thus sent to the drain 242. The incoming flow 232 surrounds a porous metal filter 312 positioned in a recess 252 in the bottom of the reservoir 240, and samples for analysis are extracted from the reservoir 240 through the filter 312. This configuration assures that the analysis examines the most recent flow into the system.

The reservoir 240 and overflow system is provided in case the metering pump 119 was temporarily to draw samples at a greater rate than the incoming flow and also to keep air out of the sample line. The reservoir 240 further comprises a low-level sensor 269 which is monitored by a control system to assure that the metering pump 119 does not draw the bath 130 level in the reservoir 240 low enough to expose the filter 312 and permit air to enter the system. The procedure for drawing a new sample begins by emptying the previous dyebath 130 from the reservoir 240 through a drain valve 260 until a low-level condition in the reservoir 240 is reached. Then the valve 260 is closed, and the transfer pump 180 delivers the new dyebath 130 until the reservoir 240 is filled to overflowing, so the metering pump 119 may draw a fresh sample. Preferably the sample is thoroughly filtered, since any particulate matter in the flow cell 210 at the time of the analysis will scatter light and cause errors in the analysis. One skilled in the art will readily recognize that other forms of reservoirs may be used.

In addition to the sample to be analyzed, the embodiment of FIG. 5 contemplates use of a reference solution, though as explained below one need not be used. The reference solution, which must be prepared, contains all of the auxiliary chemicals 72 in the dyebath 130, but does not include the dyes 64. This solution is used in this embodiment for the spectrophotometric analysis of the dyebath 130.

The reference solution is obtained before the very first carpet 10 in the sequence is dyed. After the holding tank 110 is filled with water 60 and the auxiliary chemicals 72 are added, the circulation pump 114 is turned on to mix the bath 130. A portion is then pulled the same way a dyebath sample was pulled. However, the reference sample is routed to a separate reference solution reservoir 260 rather than through the heat exchanger 314. After the reference solution is pulled, the dyes 64 are added to the bath 130 of the holding tank 110 and mixed, and the first carpet 10 can thereafter be dyed.

Because the optical properties of the auxiliary chemicals 72 in the dyebath 130 change upon the first heating and cooling cycle, the reference solution should be heated, then cooled in the same manner as the dyebath 66 in a typical dye cycle. Although not shown, a stainless steel reservoir 260 for the reference solution can be insulated and equipped with a thermocouple, an electric resistance heater, and a cooling coil through which cooling water 60 is passed and which is immersed in the reservoir 260. The electric heater heats the outside of the reservoir 260, bringing the solution to the proper temperature, and holds the solution at that temperature. After the specified hold period, the heating is stopped and water 60 is circulated through the cooling coil to bring the solution back to room temperature. Then the solution is drawn from a line 260 at the bottom of the reservoir and passes through a porous metal filter and on to the metering pump 119.

The three-way valve 308 on the discharge line of the metering pump 119 allows the solution being pumped to be routed to either the sample side or the reference side 304, 306 of the flow cell 210. All of this sample preparation equipment can be located at the holding tank 110.

It is possible that the dyebath analysis system 200 can be operated without passing a reference solution through the analysis system. For example, where a dye sample is so concentrated that the beam from light source 300 would not pass through, the sample to the spectrophotomer 320, the dyebath same can be diluted with a reference solution and the true concentration of the dyebath sample back calculated. Likewise, continuous monitoring of the dye bath may incur a dyebath sample concentration problem, also requiring dilution.

Software can be used to control and automate the operation of the analysis system 200, including the sampling valves and pumps, the operation of the spectrometer 320, and the preparation of the reference solution. As shown in FIG. 5, software also allows the analysis system 200 to communicate via any File Transfer Protocol (FTP) with a plant's central computing system 400, such as a Digital Equipment Corporation VAX, and through the use of switch signals with the beck's programmable logic controller (PLC) 410. The plant's computer system 400 collects data on all of the dyeings as well as calculates formulas for each dyeing. It also notifies the PLC 410 which one of a variety of standard dye cycles should be used for each process. The PLC 410 controls the operation of the beck 40 throughout the dyeing cycle, including control of pumps, valves, drains, water level, and temperature.

Before each dyeing in a reuse sequence is started, the computing system 400 creates a start file. The analysis system 200 reads this start file and relays the information to the PLC 410. The PLC 410 then controls the actual dyeing process based on the location of the dyeing in the reuse sequence, as determined from the start file and adjusts the steps in the dyeing process.

After the dye cycle is complete and the dyebath 66 has been sent to the holding tank 110, the analysis system 200 software calculates the concentration of the dyes 64 in the tank 110. This information is stored in a data file in the desktop computer 420 of the analysis system 200, and is retrieved by the plant's computer system 400. System 400 calculates the amount of each dye 64 in the tank 110 based on the volume of bath 130 in the tank 110 (3714 gal.). The computer 400, which already has the recipe for the next bath, calculates the amount of makeup dyes 64 needed for the next dyeing. A new formula extension sheet is printed out in the control room that shows the standard recipe, the amount of dye in the holding tank 110, and the difference, which is the adjusted recipe.

The software for the analysis system 200 and modifications to the plant's PLC 400 software allows for fall automation of the present dyebath reuse process. Since the present automated dyebath reuse process requires approximately the same amount of operator attention as the standard dyeing process, dyebath reuse can now be successfully implemented without the problems associated with human involvement.

Figure 7:
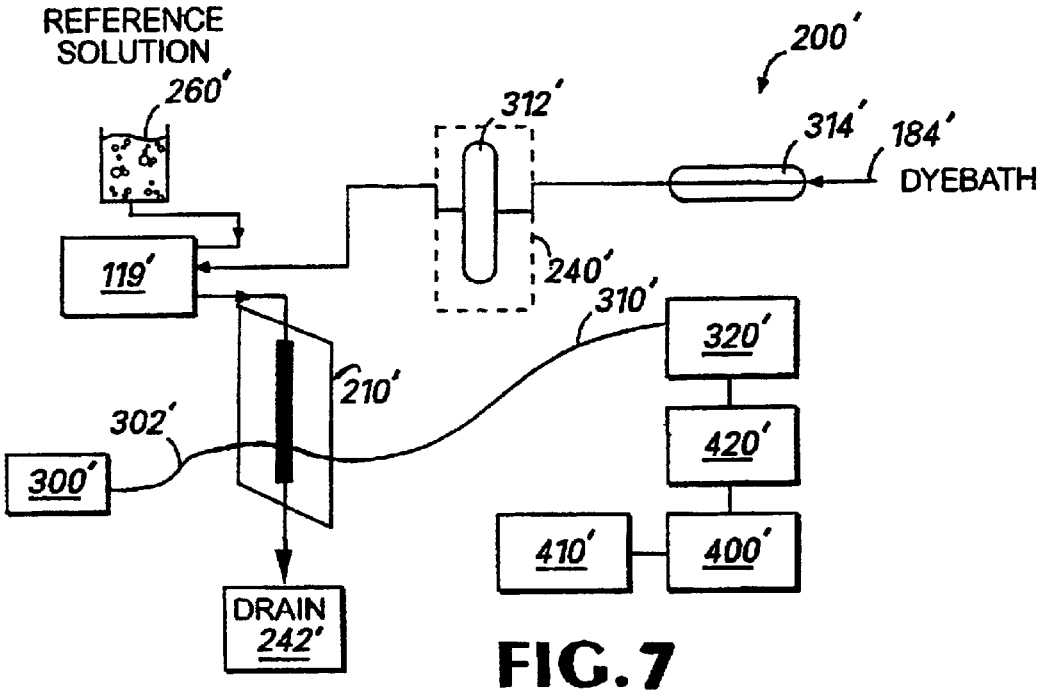
FIG. 7 is a schematic view of the components of an analysis system of the present invention according to another embodiment involving a single-beam configuration.

An alternative form of the analysis system, namely a single beam configuration, is illustrated in FIG. 7. In this embodiment, the metering pump 119', light source 300', spectrometer 320', analysis system computer 420' and system central computer 400' are the same as those in FIG. 5. This embodiment employs a single flow cell 210' and a single beam spectrophotometer 320', as opposed to the dual flow cell 210 and dual beam spectrophotometer 320 of FIG. 5. For this single beam configuration, separate pumps can deliver the dyebath and reference solution to the flow cell 210', with a 3-way valve joining one pump or the other to the flow cell. Also, the reference solution does not necessarily need to be present when the system is analyzing a dyebath sample; it can be measured in advance as a part of the calibration process and stored electronically.

There are several steps in measuring the concentration of the dyes in the bath with the above analysis system. These include acquiring the data for light absorbance by the dyebath at various wavelengths, compensating for absorbance by the non-dye components of the bath, and using the absorbance data to compute the concentration of each of the dyes in the bath. For each step, there are alternative procedures that may be followed.

As illustrated in FIG. 5 described above, one method of measuring the absorbance is to pass the light beam through both the sample and a colored filter and compare the light intensity to that obtained when the beam is passed through only the filter or through the filter and a clear sample. This permits measurement of the absorbance of the sample in the wavelength region characterized by the colored filter. Several measurements with different filters may be made sequentially or simultaneously, providing absorbance data for different regions of the optical spectrum. The number of filters typically will match the number of dyes used in the dyebath. Where three dyes are used, typically three filers, yellow, red and blue, will be used. The disadvantage of this technique is the limited flexibility to study wavelengths of interest, due to the need to provide the right filters at the right time.

An alternative method is to measure the light intensity over the entire visible spectrum (400 nm to 700 nm), with and without the light passing through the sample, and using these values to compute the absorbance of the sample at each wavelength. This method provides absorbance data for the entire visible spectrum, and the data of current interest may be used. The light is passed through the sample and through a diffraction grating. This grating provides a spatial separation of the light of different wavelengths. This spectrum then falls on a charge-coupled detector (CCD) array containing, for example, 1,024 pixels, giving the light intensity at this many wavelengths. Calibration of the detector array with a light source of known spectral characteristics permits an equation to be established relating each pixel with a particular wavelength of light.

The voltage reading from the detectors can be digitized with an analog-to-digital (A/D) converter. Irregularities (noise) in individual readings can be eased by averaging several sequential measurements and by averaging raw data for an individual pixel with the raw data for several pixels to either side.

Calculation of absorbance from the raw data values begins by establishing instrument sensitivity. Raw data values are measured (in advance as part of a calibration procedure) under conditions know as DARK and REFERENCE. The DARK values are raw data values obtained at each pixel with the light source turned off. The REFERENCE values are raw data values obtained at each pixel with the light source on and with a low-absorbance solution such as water in the flow cell. This REFERENCE value is a characterization of the instrument and should not be confused with data collected for a background "reference" solution either in one side of a dual flow cell or in a reference measurement in a single flow cell, as further discussed below.

Transmission (T) and absorbance (A) values are then calculated for each pixel from the raw data for the sample and the DARK and REFERENCE readings, using the equations:

$$T = \frac{\text{raw data value} - \text{DARK}}{\text{REFERENCE} - \text{DARK}}$$

$$A = -\log(T)$$

In analyzing a dyebath, the interest is on measuring the absorbance due to the dyes as an indicator of their concentrations. Other components of the dyebath may also absorb light, and there must be compensation for this effect. The general technique is to measure the absorbance of light by a reference solution containing all of the components of the dyebath except the dyes, then subtracting this absorbance from the absorbance of the dyebath on a pixel by pixel basis. The difference represents the absorbance by the dyes, since absorbance is additive.

There are several techniques for making this compensation with a reference solution. One technique, the dual-beam technique of FIG. 5, involves measurement of the dyebath and the reference solution. This technique can involve a dual flow cell 210, with one cell for each solution, and a dual beam spectrophotometer 320 that includes two diffraction gratings and two CCD arrays. For the dual-beam technique, the flow cells are illuminated by two identical light sources 300, 302 or, preferably, by a single light sources with a beam splitter to assure that the cells are illuminated by light beams with identical spectral characteristics.

An alternate technique, the single-beam technique of FIG. 7, involves measuring both solutions in the same flow cell 210' at different times. This technique requires only one cell 210', one light source with no beam splitter, and a single-beam spectrometer 320' (one diffraction grating and one CCD array). The single-beam technique typically involves measuring the absorbance of the reference solution, 260', storing the data for each pixel, replacing the reference solution in the flow cell with the dyebath, measuring the absorbance of the dyebath, and performing the subtraction of absorbances as described above.

An extension of the single-beam technique provides for the measurement of the reference solution to be performed perhaps well in advance as part of a calibration procedure, with the data stored in an electronic file. Data for a number of reference solutions can be stored electronically and used later in background compensations as different dyebaths are analyzed.

The dual-beam technique offers the advantage of simultaneous measurements, eliminating errors due to such factors as variations in the light source over time. The single-beam technique offers advantages for requiring fewer hardware components and fewer calibrations and characterizations of these components. The use of the single-beam technique with measurement of the reference solution as part of the calibration procedure offers the additional advantage of not requiring a reference solution to be a available at the time of measurement of each dyebath.

Once the absorbance measurement of the dyebath has been compensated for the absorbance by non-dye components, the data can be used to compute the concentration of the dyes in the bath. There are two means to perform this computation. Each means requires that calibration data be collected in advance to characterize the dyes that are contained in the bath. One method considers only three bands from the absorbance spectrum, similar to the measurements that would be made with three colored filters. The other method employs the full visible spectrum set of data.

The use of the three wavelength bands of data is the more conventional method. Absorbance spectrophotometry is typically performed using the absorbance values obtained at wavelengths of 410, 510 and 610 nm. These wavelengths are used because they are usually near the absorbance peaks of yellow, red, and blue dyes respectively, and have minimal interference from the non-peak dyes. However, a wavelengths of 425 nm can be used instead of 410 nm. Thus, the analysis system and general procedure may accommodate a wide range of conditions.

In an exemplary embodiment, data are actually used not for three single wavelengths but for three bands of the spectrum, centered on the specified wavelengths. Bands with an approximately 10-nm width can be used.

According to Beer's Law, absorbance at a given wavelength is linearly related to concentration:

$$A=alc$$

where a=molar absorbtivity of the dye l=path length of the flow cell c=concentration of the dye For measurement of a solution of mixed dyes, as it the case with the spent dyebath, the total absorbance at each wavelength is the sum of the absorbance of each dye component at that wavelength. For a particular apparatus, the path length of the flow cell is a constant, and it may be incorporated in the absorbtivity of the dyes, if the same flow cell is used for developing the calibration curves for the dyes.

In order to calculate concentrations of mixed dyes in solution, a series of calibration curves must first be prepared for each dye. Standard solutions of known concentrations are prepared for a range of concentrations of each dye. The absorbances are measured for each of these solutions at 425, 510 and 610 nm (or whichever three bands are chosen for dyebath measurements in the particular application). Linear regression of the absorbance vs. concentration data provides the slopes (m) and intercepts (b) for each of the three dye at each of three wavelengths, for a total of nine curves.

At each wavelength, the intercept values for the curves for the three dyes should theoretically be the same, since the intercepts attempt to represent the absorbance with no dye present. In practice, the linear regressions do not provide identical intercepts, and the average of the three intercepts may be used to represent the intercept for measurement at that wavelength.

Beer's law for absorbance as a function of concentration in the dyebath mixture may be expressed in matrix form, recognizing that there is a non-zero intercept, or light absorbance even at zero concentration of dye. This form of Beer's law is:

$$|A|=|m||c|+|b|$$

This may be solved for the concentration matrix:

$$|c|=|m|^{-1}\{|A|-|b|\}$$

The slope and intercept values for the nine calibration curves provide the elements for the slope and intercept matrices, and the three measured absorbances for the dyebath (after compensating for the background absorbances) provide the absorbance matrix. From these, the concentration matrix, or the concentration of each dye in the spent dyebath, may be calculated with the following matrix equation, with the subscript notations y, r, and b suggesting yellow, red, and blue dyes:

$$\begin{vmatrix} c_y \\ c_r \\ c_b \end{vmatrix} = \begin{vmatrix} m_{425,y} & m_{425,r} & m_{425,b} \\ m_{510,y} & m_{510,r} & m_{510,b} \\ m_{610,y} & m_{610,r} & m_{610,b} \end{vmatrix}^{-1} \left\{ \begin{vmatrix} A_{425} \\ A_{510} \\ A_{610} \end{vmatrix} - \begin{vmatrix} b_{425} \\ b_{510} \\ b_{610} \end{vmatrix} \right\}$$

The alternative to this conventional three-wavelength-band technique for computing concentration is to use the entire visible spectrum of data. The potential advantage is that this alternative technique makes use of all of the available data, offering increased accuracy. The disadvantage is that the data in wavelength regions of low absorbances, or where each of the dyes has similar absorbance, may contribute "noise" of about the same level as the valuable information, giving degraded accuracy.

The computational technique is derived from the assumption that at each wavelength absorbance of the dyebath (after compensation for the background absorbance) is the sum of the absorbance at that wavelength by each of the component dyes. For an assumed concentration of each of the three dyes, the calibration data provide calculated absorbances may be compared to the measured absorbance of the dyebath at that wavelength, giving an error value. The combination of assumed concentrations which results in the lowest error over the entire visible spectrum is interpreted as the best estimate of the actual concentration of the dyes in the dyebath.

This best combination of assumed concentrations is determined by the method of "lowest sum of squared errors." This technique leads to a matrix equation in which each of the elements in the matrices is a sum over all of the wavelengths measured:

$$\begin{vmatrix} c_y \\ c_r \\ c_b \end{vmatrix} = \begin{vmatrix} \sum_\lambda m_{\lambda,y}^2 & \sum_\lambda (m_{\lambda,y} \cdot m_{\lambda,r}) & \sum_\lambda (m_{\lambda,y} \cdot m_{\lambda,b}) \\ \sum_\lambda (m_{\lambda,y} \cdot m_{\lambda,r}) & \sum_\lambda m_{\lambda,r}^2 & \sum_\lambda (m_{\lambda,r} \cdot m_{\lambda,b}) \\ \sum_\lambda (m_{\lambda,y} \cdot m_{\lambda,b}) & \sum_\lambda (m_{\lambda,r} \cdot m_{\lambda,b}) & \sum_\lambda m_{\lambda,b}^2 \end{vmatrix}^{-1} \begin{vmatrix} \sum_\lambda (m_{\lambda,y} \cdot A_\lambda) \\ \sum_\lambda (m_{\lambda,r} \cdot A_\lambda) \\ \sum_\lambda (m_{\lambda,b} \cdot A_\lambda) \end{vmatrix}$$

In applying this matrix equation, the entire inverted matrix is from the calibration data and may be computed in advance. The summations in the right-hand matrix include the absorbance values for the dyebath at each wavelength and must be computed after the measurement is made.

EXAMPLES

Three sets of dyebath reuse trials were conducted to demonstrate that batch dyebaths could be automatically captured, sampled, analyzed, reconstituted, and successfully reused for dyeing of nylon carpets. The three dyebath reuse trials had progressively increasing levels of automation. These demonstrations were also to establish the ability to improve the energy, environmental, and economic performance of the dyehouse operations through automated dyebath reuse.

Example 1

The first set of trials was on a non-automated dyebath reuse process, and processed only two carpets 10, both nylon 6, 6 carpets. It was used primarily to check out the components of the system 100, which had been installed, and to identify modifications which were required. These trials tested the beck 40/tank 110 combination and the operation of the pumps and valves. Dye concentrations in the spent dyebath 130 were measured with a prototype analysis system 200 under direction of the desktop PC 420, and the results were used to adjust the makeup recipe. However, the process was not performed in an automated mode, since portions of the hardware and software were not yet ready.

Before these first trials were conducted, the analysis system 200 was calibrated using laboratory prepared dyebath solutions, each having only a single dye component. Calibration solutions were prepared for the yellow, red, and blue dyes over a range of concentrations. Analyzing several different mixed-dye solutions of known composition validated the calibration data.

The first carpet 10, nylon 6, 6, in the trial sequence was prerinsed. Simultaneously, the holding tank 110 was filled with water 60, and the dyes 64 and auxiliary chemicals 72 were sent to the tank 110 and mixed. After the prerinse water 60 was drained, the bath 130 was transferred from the holding tank 110 to the beck 40, and the carpet 10 was dyed with the standard heat-up and hold procedure. For this trial, the reference solution was mixed manually and added to the reservoir 260 in the analysis system, where it was heated and cooled by instructions manually entered at the PC 420. Heating and cooling of the reference solution is required because of a change of optical properties during the first heating cycle, and the properties of the reference solution must match those of the auxiliary chemicals 72 in the spent dyebath 130.

After the patch check, the dyebath 66 was transferred to the holding tank 110 using the hot-drop process which was previously established. Instructions were manually entered at the PC 420 to pull a sample from the holding tank 110 and analyze it for yellow, red, and blue dye concentrations. Based on the reported dye concentrations and the known volume of dyebath 130 in the holding tank 110, the total mass of each residual dye in the tank 110 was calculated manually. These quantities were subtracted from the standard recipe for the next carpet 10, and the adjusted recipe was added to the holding tank 110.

Example 2

The second carpet 10 was prerinsed with the cool-down rinse water 60 from the first carpet 10, and then dyed using the reconstituted dyebath 130 with the hot-start/hot-drop process. Both carpets 10 were dyed successfully and graded first quality.

This set of trials provided information on the capabilities and shortcomings of the hardware as it was installed and led to several changes in the system. The lint filter 150 was added in the line 120 from the beck 40 to the holding tank 110 to eliminate the buildup of fiber that could plug the piping and/or retain dye that would not be accounted for in analysis of the bath 130. Also, the water line 123 was added to the holding tank 110 for rinse-down as the reconstituted bath 130 is transferred back to the beck 40. In spite of the lack of automation, these trials did confirm the ability to reuse the dyebath with satisfactory results with this dye chemistry system.

The second set of trials were on an automated dyebath reuse process and were performed after modifications were made to the holding tank 110 and after the software for the automated analysis system 200 was complete. Those trials were automated except for calculations that were to be performed on the plant's central computer 400. The software for those calculations was not performing properly at the time of the trials, so those few calculations were performed manually.

Prior to starting this set of trials, the calibration of the analysis system 200 was again validated using several different mixed-dye solutions of known composition. The validation was performed to assure that there had been no change in the system since the earlier calibration. The trial consisted of two series of carpets 10: a four-carpet series and a five-carpet series. In this second set of trials, the carpets 10 was both nylon 6, 6 or nylon 6.

The number of carpets 10 dyed in each series was limited by the plant's production schedule; i.e., there were no more carpets 10 scheduled and available for dyeing which presented compatible shades and background chemical recipes for their use as the next carpet 10 in the series. During the period of these trials, in an attempt to minimize inventory, the carpet manufacturing process was operating on a just-in-time basis. With this system, there was a very limited number of carpets 10 tufted and queued for dyeing, limiting the flexibility to select and schedule the carpets 10 to optimize for dyebath reuse. The limited run durations do not indicate unsatisfactory performance of either the analysis system or the dyebath reuse process.

Several of the carpets 10 in the trial were off-shade at the time of the patch check and required adds 64. This is a very common practice even in the standard production. After being dried, the fourth carpet 10 in the first series was rejected as being dyed too heavy. It was subsequently redyed to a darker shade in the product line. Dyehouse management personnel attributed both 1) the adds which were required, and 2) the off-shade condition of the one carpet 10 to normal production variability rather than any aspect of the dyebath reuse process. All of the carpets were graded first quality, although the one required redyeing in order to meet standard.

The reuse dyeings were started at an average temperature of 133° F. Based on a 60° F. year-round average water supply temperature, the energy savings averaged approximately 2.3 MBTU per batch.

A portion of the auxiliary chemicals 72 are lost due to dilution and to their being retained in the wet carpet 10 when the dyebath 66 is recovered. For this reason, thirty percent of the auxiliary chemicals 72 were added as makeup in each batch, which translates to an average savings of 48.2 pounds of chemicals 72 per batch, benefiting the process economics and reducing the pollutants released to the wastewater stream.

Example 3

For the final set of trials, all of the hardware and software modifications had been completed, and the trials were performed in automated mode, including transfers of the bath 66, 130 between the beck 40 and holding tank 110, sampling and analysis of the spent dyebath 130, and calculation of the adjusted recipe for reconstitution of the bath 130. The analysis system 200 was recalibrated for this trial, and the new calibration data were validated using solutions of known composition.

In this trial of automated dyebath reuse, a series of five carpets 10, all nylon 6, 6, were dyed, with the duration of the trial again limited by availability of suitable carpets 10 in the dyeing queue. The average process start temperature for the reuse dyeings in this series was 139° F. The average energy savings were 2.45 MBTU per batch. The average auxiliary chemical 72 savings per batch were 64.8 pounds.

All of the carpets 10 were first quality with the exception of the last one in the series, which required several adds and subsequently was downgraded and redyed. It was not clear whether the need to redye this carpet 10 was related to normal variability or to some aspect of the analysis 200 and reuse process. There was a substantial quantity of residual blue dye in the bath 130 recovered from the fourth carpet 10 which could have lead to an erroneous analysis. However, such an error would have only shifted the initial dyeing of the fifth carpet 10, and such errors can usually be corrected by adds, which were not effective with this particular carpet 10. Thus, it cannot be stated conclusively whether the need for this redye should be attributed to the demonstration technology and system or not.

The process of one embodiment of the present invention is as follows:

i. Prerinse the first carpet in the sequence
- Roll carpet onto reel
- Back carpet into beck
- Sew carpet and fill beck
- Turn on circulation pump and reel
- Let carpet prerinse
- Dump prerinse bath to the drain ii. Prepare first dyebath (done simultaneously with the prerinse)
- Fill holding tank with water
- Add defoamer to holding tank
- Add auxiliary chemicals to holding tank
- Turn on circulation pump to mix chemicals
- Draw reference sample from holding tank and prepare for analysis
- Drop dyes to holding tank
- Mix bath in the holding tank iii. Dye first carpet
- Transfer bath from the holding tank to the beck and flush residual bath from holding tank
- Turn on beck recirculation pump and reel
- Heat bath to the hold temperature
- Maintain bath at hold temperature for standard time
- Perform patch checks and adds as necessary iv. Transfer bath to holding tank
- Pump a portion of bath to holding tank
- Partially fill beck to cool bath and carpet
- Pump to holding tank until the level in the tank is fill
- Dump residual dyebath to the drain
- Fill beck to further cool the carpet and aid in pulling v. Pull carpet from beck vi. Analyze spent dyebath (simultaneously with pulling carpet from beck)
- Pull sample from holding tank
- Analyze sample
- Calculate concentration
- Calculate makeup auxiliary chemicals and makeup dyes vii. Prerinse carpet with cooling water from previous carpet
- Drop water level in beck
- Roll carpet onto reel
- Back carpet into beck
- Sew carpet
- Add leveling agent
- Turn on circulation pump and reel
- Let carpet prerinse
- Dump prerinse bath to the drain viii. Prepare dyebath for reuse (simultaneously with vii)
- Add defoamer to holding tank
- Prepare makeup chemicals and dyes and add to the holding tank.
- Turn on holding tank circulation pump and mix bath ix. Dye carpet
- Transfer dyebath from the holding tank to the beck
- Heat to the hold temperature
- Maintain bath at the hold temperature for the amount of time in a standard dyeing plus 30 minutes If the bath is to be reused, the cycle is started again from step # iv. If the bath is not to be reused, a standard cool-down cycle takes place; then the bath is dumped to the drain.

Other embodiments of the present invention include, for example, a single analysis system 200 used for one holding tank 110 serving one test beck 60. The plant where the demonstrations of the present invention were conducted has sixteen becks 40 in production. In a plant-wide system, appropriate piping could permit becks 40 to alternately use the same holding tanks 110 so that fewer holding tanks 110 would be required than the number of becks 40. A single analysis system 200 could also serve multiple holding tanks 110. Further, automated dyebath reuse may be used in other textile processes.

As part of the commercialization effort, several techniques can be employed which may improve the accuracy of absorbance data obtained with the present analysis system 200. One technique is to replace the existing tungsten halogen light source 300 with a xenon flash or strobe lamp, and modify the analysis system 200 software accordingly. The higher light output would improve the performance of the system 200 since low light output, especially in the short wavelength region, is currently a limiting factor in performance of the analysis system 200.

The present invention can be applied to a wide range of dye, fiber and product combinations, and not just the acid dyeing of nylon carpet. Automated dyebath reuse can be implemented in the batch dyeing of other textile products such as yarn and fabrics.

The automated analysis 200 for acid dyes may also be used with other water-soluble dyes such as direct, basic and reactive dyes to support automated dyebath reuse on different types of fibers. For example, reactive dyes are commonly used to dye cotton. During the dyeing process the dyes undergo a chemical change so that even the residual dyes are not in the same state as at the beginning of the cycle. This presents an impediment to dyebath reuse. However, this application is of significant interest, because the conventional reactive dye process consumes large quantities of salt that are released with the dye wastewater stream. This release of salt-laden wastewater is considered the single most serious water pollution problem facing the textile industry. The conventional process may be modified to permit the baths to be reused, retaining the water, energy, dyes, and salt in the process.

Similar automated analysis 200 procedures can be developed for non-soluble dyes such as disperse dyes, used for polyester. Since these dyes are not soluble in water, the preferred analysis system 200 would experience analysis errors due to separation of the dyes from the water in the sample. Corrective measures would include mixing the sample with a solvent in order to place the dye in solution during the spectrophotometric analysis. The metering pump 119 used in the preferred analysis system 200 was designed for high performance liquid chromatography and is capable of mixing precise quantities of liquids. The pump 119 can be used to add solvent at known concentrations to the samples before they are delivered to the flow cell 210 for analysis.

The automated dyebath analysis system 200 can also be used to monitor dye concentrations continuously throughout the dye cycle. Samples can be drawn directly from the beck 40 for real-time concentration analysis. Continuous monitoring of the dye concentrations can provide a new process control parameter not previously available in batch dyeing. Presently, monitoring time and temperature controls batch dyeings. By improving control of the dyeing process, the number of off-shade dyeings can be reduced or eliminated. This would decrease the amount of adds and redyes, which would save time and money, as well as water, chemicals and energy. Continuous concentration monitoring could also possibly lead to the development of new dyeing strategies, such as introducing the dyes throughout the cycle, rather than all at once. Continuous monitoring of dye concentrations can be applied as a control technique not only to batch dyeing, but to continuous dyeing processes as well.

Although the present invention has been described with respect to particular embodiments, it will be apparent to those skilled in the art that modifications to the method of the present invention can be made which are within the scope and spirit of the present invention and its equivalents.

What is claimed is:

1. A method for analyzing the dye concentration in a dyebath ample, comprising She steps or:

(a) drawing a dyebath sample from a dyebath;

(b) measuring light absorbance of the dyebath sample as at last one wavelength;

(c) measuring light absorbance or the non-dye components or the dyebath at the some wavelength; and (d) using the measured light absorbance of the dyebath sample and the non-dye components of the dyebath to calculate the concentration of the dye in the dyebath.

2. The method of claim 1, wherein the light absorbance is measured at a plurality of wavelengths.

3. The method of claim 1, further comprising:

(e) calculating a makeup dye concentration of the one or more dyes in the dye bath based on the calculation of the dye concentration in the dyebath.

4. The method of claim 3, wherein the dye concentration is calculated according to Beer's Law.

* * * * *